US005321998A

United States Patent [19]

Brown

[11] Patent Number: 5,321,998

[45] Date of Patent: Jun. 21, 1994

[54] POSITIVE ENGAGEMENT POWER TRANSMISSION TOOL

[75] Inventor: Bruce M. Brown, Shelton, Conn.

[73] Assignee: United Technologies Corporation, Hartford, Conn.

[21] Appl. No.: 15,189

[22] Filed: Feb. 10, 1993

[51] Int. Cl.[5] ..... B25B 23/08

[52] U.S. Cl. ..... 81/451; 81/176.1; 81/462

[58] Field of Search ..... 81/52, 176.1, 176.15, 81/180.1, 451, 460, 462

[56] References Cited

U.S. PATENT DOCUMENTS 2,721,589 10/1955 Hammer ..... 81/462

*Primary Examiner*—James G. Smith
*Attorney, Agent, or Firm*—Michael Grillo

[57] ABSTRACT

A power transmission tool for the installation and removal of a spanner nut (15) on a threaded end of a drive shaft (27) comprises a torque reactor plate (32) with a central threaded aperture (35,37) for threaded engagement with a wrench shaft (39). The pitch of the wrench and reactor plate threads (37,39) is the same as the pitch of the drive shaft and spanner nut threads. The reactor plate (32) is fastened (60,63,65) to a drive flange (20), the flange being mounted on an end of the drive shaft and having splines to prevent relative movement therebetween. An aperture (73) is formed in the torque reactor plate for receiving a bar which is used to react the torque applied to the drive shaft/flange combination by the wrench via the nut, thereby preventing rotation of the flange and shaft combination when torque is applied to the wrench.

8 Claims, 3 Drawing Sheets

*fig. 1 prior art*
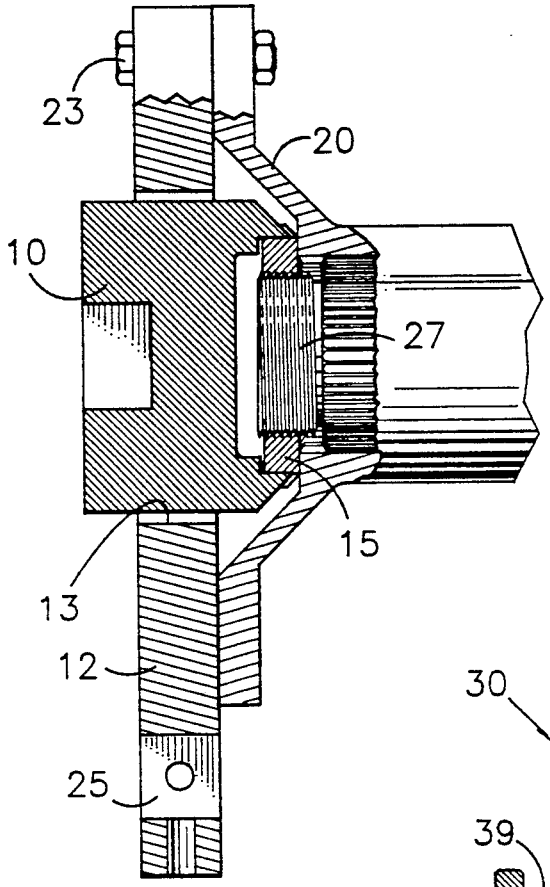
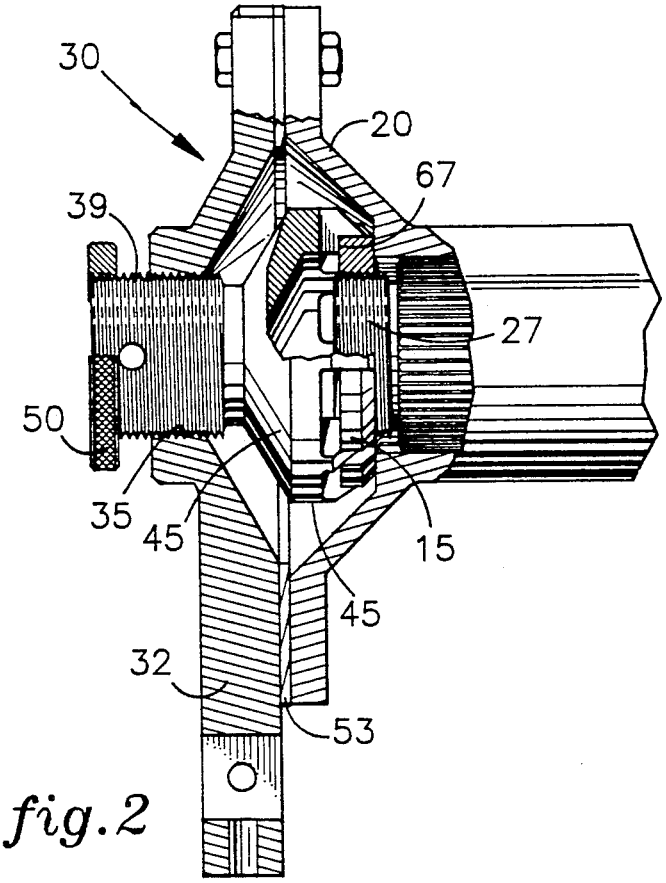
*fig. 2*

POSITIVE ENGAGEMENT POWER TRANSMISSION TOOL

TECHNICAL FIELD

The present invention relates to power transmission tools, and more particularly to a tool which provides positive engagement of a driving wrench with a driven nut throughout all wrenching operations.

BACKGROUND OF THE INVENTION

Aeronautical spanner nuts are used to secure power transmission drive flanges to the input and output ends of power transmission drive shafts on helicopter tail rotor drive systems. Each drive flange and the drive shaft are provided with splines to prevent relative movement therebetween, and a spanner nut holds the flange on the drive shaft.

To properly torque a spanner nut on the threaded end of a drive shaft, up to several thousand inch pounds of torque must be applied. Because of the location of the spanner nut within the drive flange, special power transmission tools have been developed to apply the proper torque when attaching the spanner nut, and for applying torque to remove the spanner nut. Referring to FIG. 1, present tools used to attach aeronautical spanner nuts typically include a cylindrical wrench 10 which is concentrically piloted within a torque reactor plate 12. An aperture 13 in the torque reactor plate and the surface of the wrench act as a bearing and hold the wrench in alignment with a spanner nut 15. During installation or removal of the spanner nut, the torque reactor plate 12 is mounted to a drive flange 20 with a plurality of fasteners 23. An aperture 25 is formed in the reactor plate to receive a bar or other tool (not shown) to react the torque applied to the wrench 10, thereby preventing the transmission shaft 27 and flange 20 combination from rotating when torque is applied to the wrench 10, e.g., using a standard torque wrench. Two operators are required during removal or installation of the spanner nut in the field because of the torque involved; one person to operate the torque wrench and one person to apply torque to the reactor plate via the bar.

A problem associated with the present method of installing and removing a spanner nut on the end of a drive shaft is that when torque is applied to the wrench 10, the wrench tends to jump out of and away from the slots of the spanner nut 15. This results in several problems. First, the tangs which project from the wrench for engagement with the spanner nut become rounded or damaged, and the slots in the spanner nut which receive the tangs tend to become rounded. Therefore, the wrench and the spanner nut may become unusable and lead to a great deal of problems in trying to remove the spanner nut 15 without damaging the power transmission shaft 27 and flange 20. Additionally, if the wrench breaks free from the spanner nut when the wrench operator is applying up to several thousand inch pounds of torque, the wrench and/or reactor operator could be injured by the tool or by a fall.

DISCLOSURE OF INVENTION

Objects of the inventions include provision of a positive engagement power transmission tool for installation and removal of a spanner nut on a power transmission drive shaft, the tool providing maximum engagement between a driving wrench and the driven nut throughout all wrenching operations, and allowing accurate measurement of torque applied to the driven nut.

According to the present invention, a power transmission tool for the installation and removal of a spanner nut on a threaded end of a drive shaft comprises a torque reactor plate with a central threaded aperture for threaded engagement with a wrench shaft, the pitch of the wrench and reactor plate threads being the same as the pitch of the drive shaft and spanner nut threads.

In further accord with the present invention, the reactor plate is fastened to a flange, the flange being mounted on an end of the drive shaft and having splines to prevent relative movement therebetween, an aperture is formed in the torque reactor plate for receiving a bar which is used to react the torque of the wrench, thereby preventing rotation of the flange and shaft combination when torque is applied to the wrench.

The power transmission tool of the present invention provides a significant improvement over prior art power transmission tools because maximum engagement is maintained between the driving wrench and the driven nut throughout the wrenching operation. This maximum engagement is accomplished by the threading of the wrench shaft and the reactor aperture with the same number of threads per inch as the shaft and nut being installed. As the combination of the wrench and nut are simultaneously threaded into and onto the combination of reactor driver and shaft, the axial engagement of the tool to the nut is maintained constant. Misalignment is completely prohibited in all planes.

The foregoing and other objects, features and advantages of the present invention will become more apparent in light of the following detailed description of exemplary embodiments thereof, as illustrated in the accompanying drawings.

BRIEF DESCRIPTION OF THE DRAWINGS

FIG. 1 is a perspective view, partially broken away, of a prior art power transmission tool mounted on the end of a tail rotor drive shaft;

FIG. 2 is a perspective view, partially broken away, of the power transmission tool of the present invention mounted on an end of a helicopter tail rotor drive shaft;

BEST MODE FOR CARRYING OUT THE INVENTION

The power transmission tool of the present invention is particularly well suited for applying a high degree of torque during the installation or removal of an aeronautical spanner nut 15 on the threaded end of a drive shaft 27 while maintaining maximum engagement between a driving wrench and the nut during installation or removal. Additionally, during installation and removal of a nut, the power transmission tool maintains positive axial engagement of the wrench to the nut while preventing misalignment in all planes.

Figure 3:
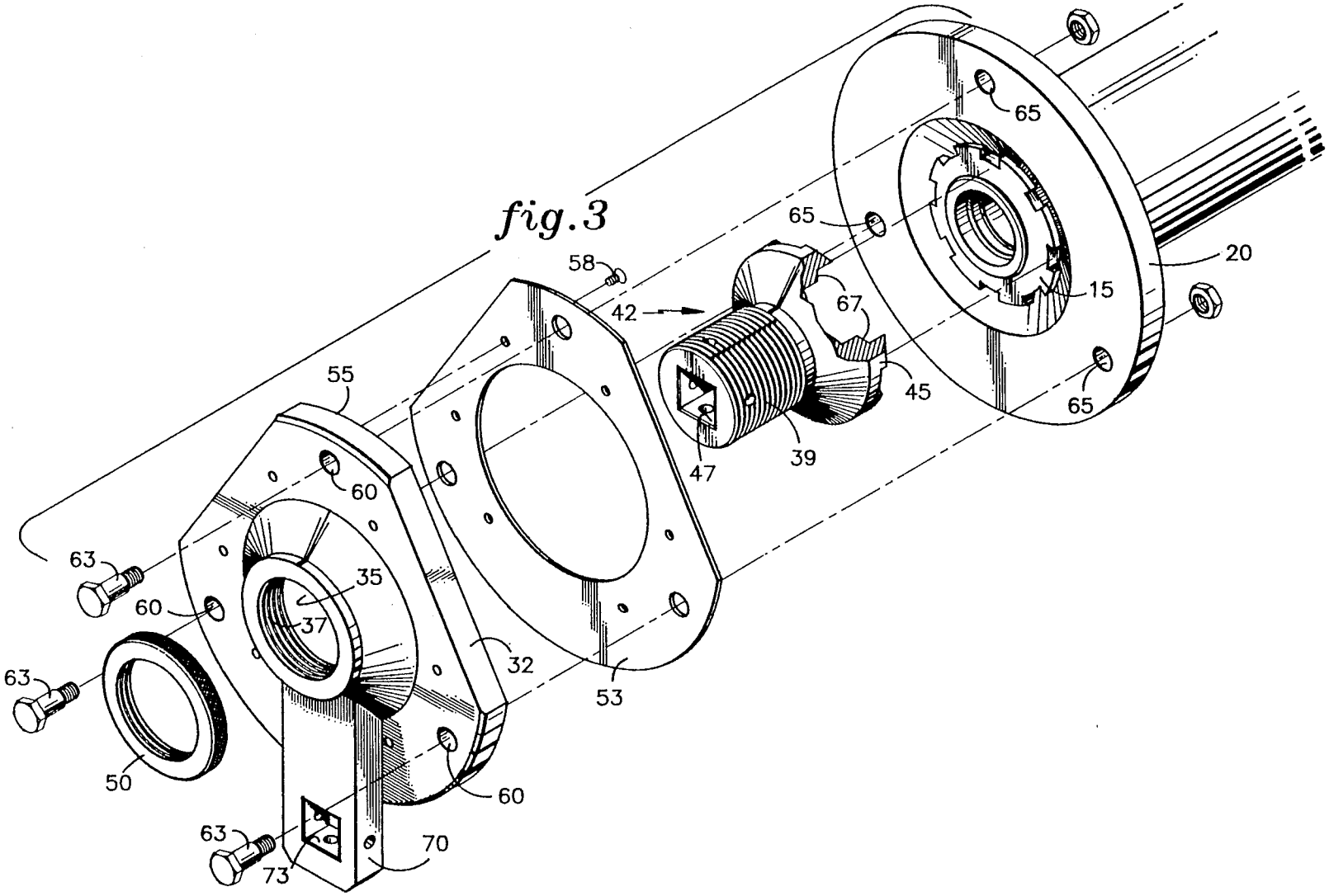
FIG. 3 is an exploded view of the power transmission tool of FIG. 2.

Referring to FIGS. 2 and 3, a power transmission tool 30 of the present invention comprises a torque reactor plate 32 having a centrally located aperture 35. The central aperture is threaded 37 for receiving the threaded shaft 39 of a wrench 42. The pitch of the shaft and reactor plate threads 37,39 is the same as the pitch of the drive shaft and spanner nut threads.

A drive socket 45 is integrally formed at one end of the shaft for engagement with the aeronautical spanner nut 15. An aperture 47 (socket) is formed in the opposing end of the shaft for receiving the drive portion of a torque wrench or other suitable socket type wrench (not shown). Typically, the drive portion of a torque wrench is square, and is referred to as a "square drive". Therefore, the aperture 47 is shown as being square. However, the aperture 47 may be hexagonal, rectangular or any other shape, depending on the type of torque wrench to be used. By using the same thread pitch on the wrench/reactor plate threads and the spanner nut/-drive shaft threads, the drive socket and spanner nut move the same distance in response to operation of the tool, thereby preventing binding of the drive socket and nut. This also allows accurate torque measurements throughout the wrenching operation. To further enhance the accuracy of torque measurements, a low friction lubricant, e.g., a silicon based lubricant, is used between the wrench and reactor plate threads to minimize friction therebetween.

A knurled operator handle 50 may be mounted on the end of the wrench adjacent the aperture for allowing hand operation of the wrench. The operator handle 50 also protects the male threads on the wrench shaft 39 when the tool is resting on a side. The knurled operator handle 50 may be threaded for mounting on the shaft, and may be locked in place using a known thread locking compound, e.g., epoxy resin, spot welding, or other suitable method or material. The handle may also be held in fixed relation to the shaft by a pin (not shown) which extends through the handle and into the shaft.

The reactor plate 32, wrench 42 and operator handle 50 may be machined from a high strength steel such as aircraft quality steel. To prevent damage to a power transmission drive flange 20 during installation or removal of an aeronautical spanner nut 15 on a power transmission drive shaft 27, a wear plate 53 is attached to a mating surface 55 of the reactor plate 32 using a plurality of fasteners 58, i.e., machine thread screws. The wear plate 53 is made of a material which is softer than the drive flange 20, such as aluminum.

Figure 4:
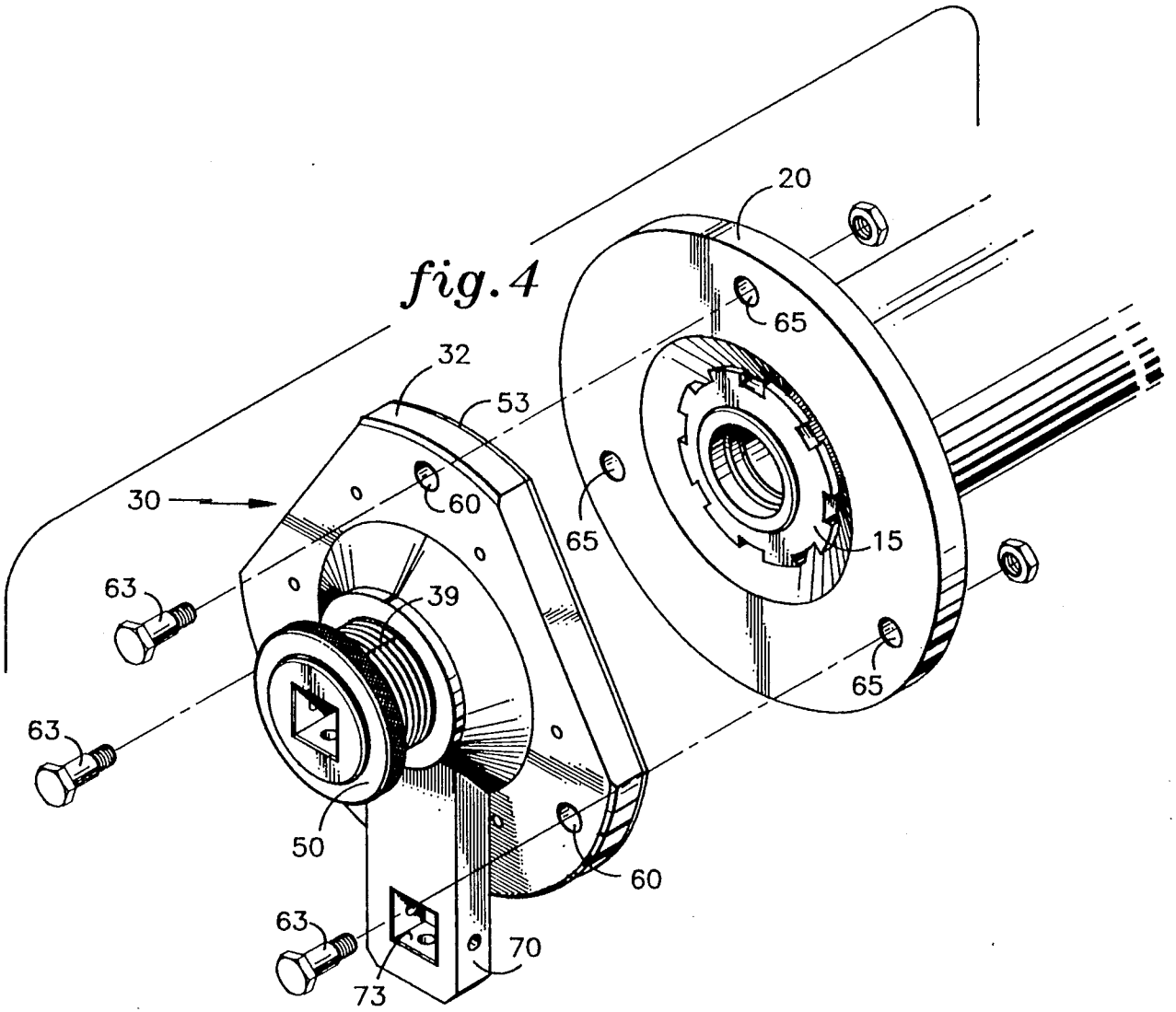
FIG. 4 is a perspective view of the power transmission tool of FIG. 2 in relation to an end of a helicopter tail rotor drive shaft.

The operation of the wrench is best understood by example. Referring to FIGS. 3 and 4, prior to installation of the tool 30 on the power transmission, the wrench shaft threads 39 are lubricated, and the reactor plate 32 is threaded up the wrench shaft away from the drive socket 45 and towards the operating handle 50. The drive socket 45 is then engaged with the spanner nut 15. The wrench shaft 39 is held in place while the reactor plate 32 is threaded down the wrench shaft until the wear plate 53 comes in contact with the drive flange 20. A plurality of apertures 60 are formed around the periphery of the torque reactor plate 32. Similarly, a plurality of apertures 65 are formed around the periphery of the drive flange. Fasteners 63, i.e., shoulder bolts, are provided for mounting the reactor plate to the drive flange.

The reactor plate 32 is threaded an additional one-third to one-half turn down the wrench shaft 39 after the wear plate 53 engages the drive flange until the apertures 60 in the reactor plate are aligned with the apertures 65 in the drive flange 20. The fasteners 63 are then received through the aligned apertures 60,65, and securely fastened. By continuing to screw down the reactor plate an additional one-third to one-half turn, a gap of approximately twenty one-thousandths of an inch is formed between the face 67 of the wrench drive socket 45 and the spanner nut 15 to thereby eliminate binding and false torque readings. The gap is sufficient to account for differences between the reactor place/-wrench shaft threads and the drive shaft/spanner nut threads so that no binding occurs between the drive socket 45 and spanner nut 15 during the wrenching operation.

Once the reactor plate 32 is aligned with, and secured to the drive flange, the wrench may be operated for torquing the spanner nut or removing the spanner nut as desired. As described hereinbefore, the drive flange 20 and drive shaft 27 are splined to prevent relative movement therebetween. The drive flange and drive shaft combination will rotate when rotational torque is applied to the drive shaft, and therefore, a torque arm 70 is formed on the reactor plate 32 to react the torque applied the drive shaft by the wrench 42. An aperture 73 is formed in the torque arm 70 for receiving a bar or other tool (not shown) to thereby increase the effective length of the torque arm to provide a mechanical advantage during operation of the tool. Although the arm 70 is shown as an integral part of the plate, it may be removably mounted (interchangeable). During initial assembly or bench repair of transmissions and drive shafts, the arm 70 may be replaced with an extended arm which may be gripped in a stationary vice or clamp. In this case, an operator is not required to supply the reaction torque, an only one operator is required for the wrenching operation.

The invention is described herein for installing an aeronautical spanner nut on a helicopter tail rotor transmission drive shaft. However, the invention will work equally as well with any type of power transmission of the type having a drive flange and drive shaft. It is important in any application of the invention that the pitch of the wrench/reactor plate threads be the same as the spanner nut/drive shaft threads, to thereby prevent binding of the drive socket and nut. This also allows accurate torque measurements throughout the wrenching operation.

The power transmission tool of the present invention is not only limited to transmissions drive shafts. The invention will work equally as well for installing a nut on any type of rotating shaft provided that a surface (like the drive flange) is provided for attaching the reactor plate to thereby allow the torque applied to the wrench to be reacted.

Although the invention has been described and illustrated with respect to exemplary embodiments thereof, it should be understood by those skilled in the art, that the foregoing and various other changes, omissions, and additions may be made therein and thereto without departing from the spirit and scope of the present invention.

I claim:

1. A tool for installation and removal of a nut on a threaded end of a rotatable shaft, comprising:

a reactor plate having a threaded aperture;

means for holding said reactor plate in fixed relationship to said rotatable shaft with said threaded aperture in axial alignment with said rotatable shaft; and a wrench having a threaded shaft for threaded engagement with said threaded aperture, a drive socket on one end of said threaded shaft for engagement with said nut, and means for applying torque to said threaded shaft on the other end of said threaded shaft;

said threaded shaft and said threaded aperture having a thread pitch which is the same as the thread pitch of said nut and the threaded end of said rotatable shaft.

2. A tool according to claim 1 wherein said means for applying torque to said shaft comprises an aperture formed in said other end of said shaft for receiving a drive portion of a socket wrench.

3. A tool according to claim 2 wherein said socket wrench is a torque wrench.

4. A tool according to claim 1 further comprising a torque reacting arm attached to said reactor plate, torque applied to said reacting arm opposing torque applied to said rotatable shaft by said wrench via said nut.

5. A tool according to claim 4 wherein said arm comprises an aperture for receiving a bar for increasing the effective length of said arm.

6. A tool according to claim 1 wherein said rotatable shaft is a transmission drive shaft having a drive flange held on the end of said drive shaft by said nut, said drive shaft and said flange having splines to prevent relative movement therebetween, and wherein said means for holding said reactor plate in fixed relationship to said rotatable shaft comprises:

at least one aperture formed in said drive flange;

at least one aperture formed in said reactor plate being axially aligned with said aperture in said drive flange when said threaded aperture is in axial alignment with said drive shaft; and fastening means received through said aligned apertures.

7. A tool according to claim 6 further comprising a wear plate mounted to said reactor plate, between said reactor plate and said drive flange, said wear plate being manufactured of a softer material than said drive flange.

8. A tool according to claim 1 further comprising an operator handle mounted on said other end of said shaft.

* * * * *